US008305405B2

(12) United States Patent
Law et al.

(10) Patent No.: US 8,305,405 B2
(45) Date of Patent: Nov. 6, 2012

(54) ELECTROSTATIC DIGITAL OFFSET/FLEXO PRINTING

(75) Inventors: Kock-Yee Law, Penfield, NY (US); Mandakini Kanungo, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 300 days.

(21) Appl. No.: 12/854,526

(22) Filed: Aug. 11, 2010

(65) Prior Publication Data

US 2012/0037026 A1 Feb. 16, 2012

(51) Int. Cl.

| | |
|---|---|
| ***B41J 2/41*** | (2006.01) |
| ***G03G 15/02*** | (2006.01) |
| ***G03G 13/20*** | (2006.01) |
| ***G03G 13/16*** | (2006.01) |
| ***B41F 1/16*** | (2006.01) |

(52) U.S. Cl. ..... 347/112; 430/58.05; 430/124.1; 430/125.3; 101/492

(58) Field of Classification Search ..... None
See application file for complete search history.

(56) References Cited

U.S. PATENT DOCUMENTS

| | | | |
|---|---|---|---|
| 6,387,588 | B1 | 5/2002 | Katano et al. |
| 6,725,777 | B2 | 4/2004 | Katano |
| 7,061,513 | B2 | 6/2006 | Katano et al. |

OTHER PUBLICATIONS

Weeks, Chris, Paul Glatkowski and David Britz, "Green carbon nanotubes," Micro/Nano, the Newsletter of Tools and Products in Micro and Nanotechnology, Jan. 2007, vol. 12, No. 1, pp. 5-6.
Katano Yasuo et al., "The New Printing System Using the Materials of Reversible Change of Wettability," International Congress of Imaging Science, 2002, Tokyo, 2 Pages.
Peltola, J., C. Weeks, I.A. Levitsky, D.A. Britz, P. Glatkowski, M. Trottier and T. Huang, "Carbon-Nanotube Transparent Electrodes for Flexible Displays," Information Display, Feb. 2007, pp. 2-5.
Weeks, Chris, "Flexible carbon nanotube transparent electrodes," Veritas et Visus, Flexible Substrate, Oct. 2006, pp. 40-43.

*Primary Examiner* — Stephen Meier
*Assistant Examiner* — Alexander C Witkowski
(74) *Attorney, Agent, or Firm* — MH2 Technology Law Group LLP

(57) ABSTRACT

Various embodiments provide systems and methods for digital offset/flexo printing by selectively addressing one or more hole-injecting pixels of a nano-enabled imaging member to form a latent image thereon, wherein the latent image can be electrostatically developed with an ink and then transferred from the nano-enabled imaging member onto a print media.

20 Claims, 5 Drawing Sheets

ELECTROSTATIC DIGITAL OFFSET/FLEXO PRINTING

RELATED APPLICATION

Reference is made to co-pending, commonly assigned U.S. patent application Ser. Nos. 12/539,397 and 12/539,557, both entitled "Digital Electrostatic Latent Image Generating Member" and filed Aug. 11, 2009, and U.S. patent application Ser. No. 12/869,605, entitled "Direct Digital Marking Systems," filed Aug. 26, 2010, the disclosures of which are incorporated herein by reference in their entirety.

DETAILED DESCRIPTION

1. Field of Use

The present teachings relate to xerographic printing, flexo printing and offset printing and, more particularly, to systems and methods of digital offset/flexo printing.

2. Background

Traditional offset printing and/or flexo printing technologies offer pictorial image quality at low run cost. However, traditional offset printing and/or flexo printing (also referred to herein as offset/flexo printing) processes are analog printing processes and their run cost becomes a drawback at short run lengths and for variable data printing. Digitizing the offset/flexo printing is desirable to capture the short run and variable data printing opportunity while retaining the pictorial image quality.

Additionally, traditional offset/flexo printing technologies depend on surface hydrophobicity contrast and include a multi-step process involving plate development. Hence, it is also desirable for digital offset/flexo printing technologies to provide simplified alternative methods and systems. It is further desirable for the digital offset/flexo printing technologies to be environmental-friendly.

Accordingly, there is a need to provide a printing system to enable digitalization of offset/flexo printing and methods of using the printing system.

SUMMARY

According to various embodiments, the present teachings include a digital printing method. The digital printing method can use a nano-enabled imaging member that includes an array of hole-injecting pixels disposed over a substrate and a charge transport layer disposed over the array of hole-injecting pixels with each pixel electrically isolated and individually addressable. A negative surface charge can be generated on a surface of the charge transport layer to form a latent image, for example, by selectively addressing one or more pixels of the array of hole-injecting pixels to discharge a portion of the negative surface charge corresponding to the selectively addressed one or more pixels. An ink can then be provided in proximity to a development nip formed by a development subsystem and the nano-enabled imaging member. The provided ink can include a charged offset ink and an optionally charged flexo ink. The latent image can then be electrostatically developed with the provided ink at the development nip to form a developed image on the charge transport layer of the nano-enabled imaging member, which can then be transferred from the nano-enabled imaging member onto a media.

According to various embodiments, the present teachings also include a digital printing system. The system can include a nano-enabled imaging member for forming an electrostatic latent image, the nano-enabled imaging member including an array of hole-injecting pixels disposed over a substrate and a charge transport layer disposed over the array of hole-injecting pixels with each hole-injecting pixel electrically isolated and individually addressable. The system can also include a first charging subsystem for uniformly charging a surface of the charge transport layer of the nano-enabled imaging member to form a substantially uniform negative surface charge on the charge transport layer. The system can also include a digital latent image generating subsystem coupled to the nano-enabled imaging member to discharge a portion of the negative surface charge and form a latent image on the nano-enabled imaging member. A development subsystem can be used for developing the latent image with an ink through a development nip formed by the development subsystem and the nano-enabled imaging member. The ink can include a charged offset ink and/or an optionally charged flexo ink. The system can further include a transfix subsystem for transferring and fixing the developed image from the nano-enabled imaging member onto a media.

According to various embodiments, the present teachings further include a digital printing method. The digital printing method can use a nano-enabled imaging member that includes an array of hole-injecting pixels disposed over a substrate and a charge transport layer disposed over the array of hole-injecting pixels with each pixel electrically isolated and individually addressable via an array of thin film transistors disposed over the substrate. A negative surface charge can then be formed on a surface of the charge transport layer opposite to the array of hole-injecting pixels to form a latent image, by selectively addressing one or more hole-injecting pixels of the array of hole-injecting pixels to inject holes at interface of the charge transport layer and each of the one or more selectively addressed pixels, such that a portion of the negative surface charge corresponding to the one or more selectively addressed pixels is discharged. A UV-curable ink can then be optionally charged and provided in proximity to a development nip formed by a development subsystem and the nano-enabled imaging member. The optionally charged UV-curable ink can include a charged UV-curable offset ink and an optionally charged UV-curable flexo ink. The formed latent image can then be electrostatically developed at the development nip with the optionally charged UV-curable ink to form a developed image on the nano-enabled imaging member. The developed image can be partially UV-cured to form a partially cured developed image on the nano-enabled imaging member and transferred onto the media, followed by a curing process of the partially cured developed image on the media.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Figure 1:
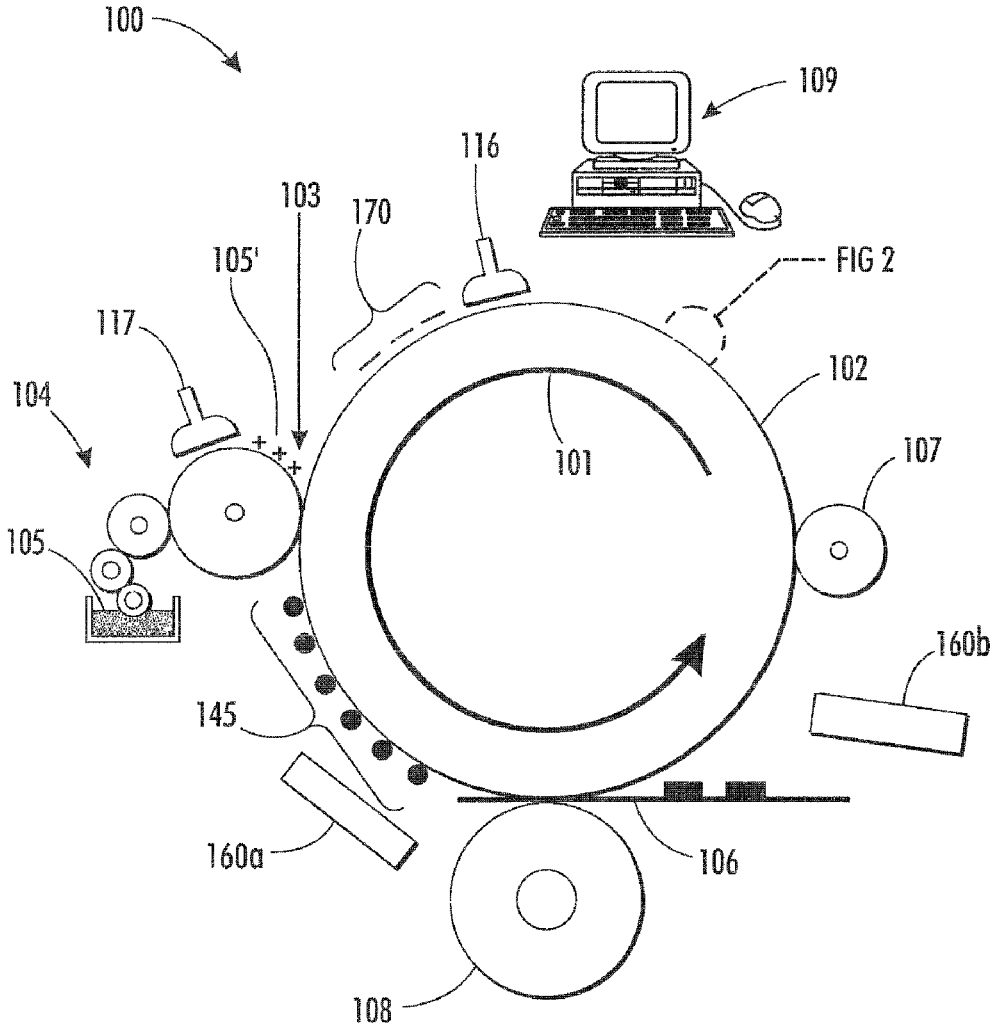
FIG. 1 schematically illustrates a portion of an exemplary digital offset printing system according to various embodiments of the present teachings.

FIG. 1 schematically illustrates a portion of an exemplary digital offset printing system 100, according to various embodiments of the present teachings. The exemplary digital offset printing system 100 can include a nano-enabled imaging member 102 for forming an electrostatic latent image. The nano-enabled imaging member 102 can rotate in a direction 101.

Nano-Enabled Imaging Member

Figure 2:
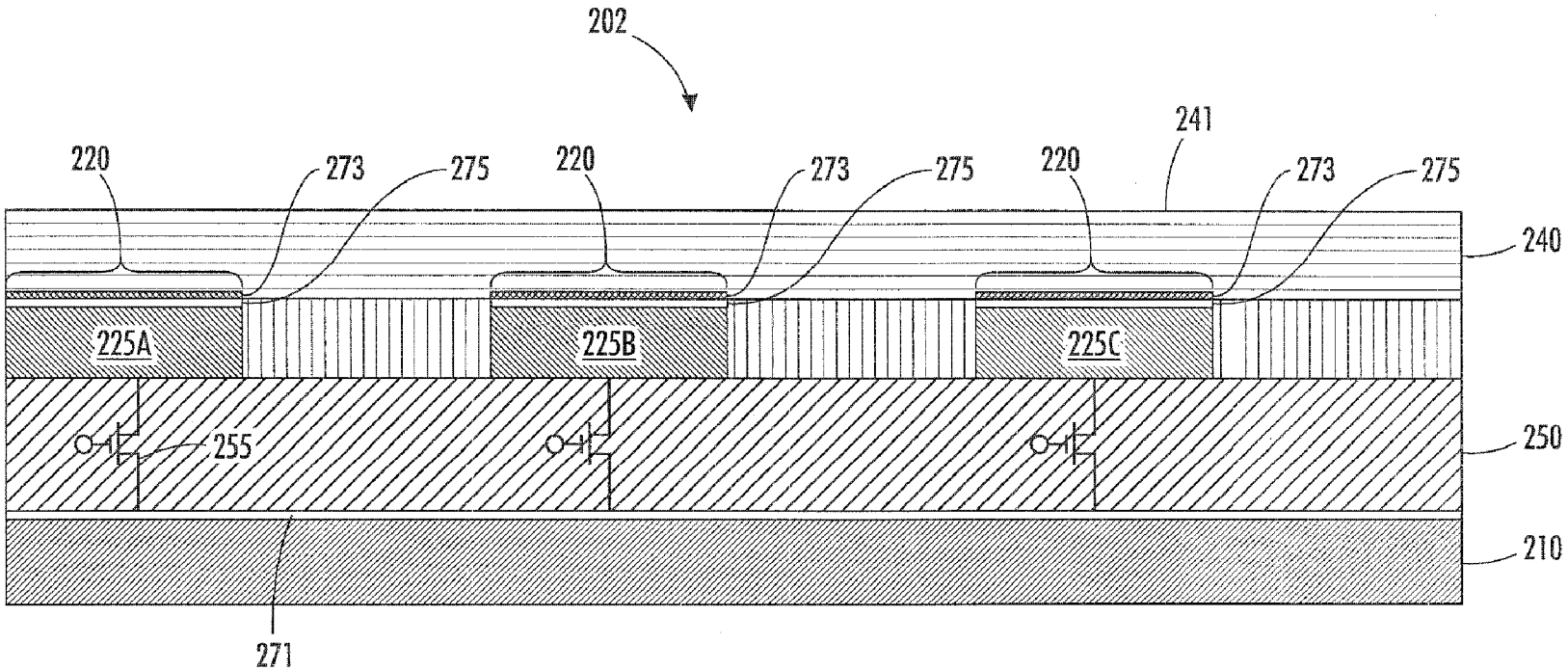
FIG. 2 schematically illustrates a cross sectional view of a portion of an exemplary nano-enabled imaging member according to various embodiments of the present teachings.

FIG. 2 schematically illustrates a cross sectional view of a portion of the nano-enabled imaging member 102, 202, in accordance with various embodiments of the present teachings. The nano-enabled imaging member 102, 202 can include an array of hole-injecting pixels 225 disposed over a substrate 210, such that each pixel 225 of the array of hole-injecting pixels 225 is electrically isolated and is individually addressable. The nano-enabled imaging member 102, 202 can also include an array of thin film transistors 250 disposed over the substrate 210, such that each thin film transistor 255 can be coupled to one pixel 225 of the array of pixels 225. The nano-enabled imaging member 102, 202 can further include a charge transport layer 240 disposed over the array of hole-injecting pixels 225, wherein the charge transport layer 240 can include a surface 241 disposed opposite to the array of hole-injecting pixels 225. The charge transport layer 240 can be configured to transport holes provided by the one or more pixels 225 to the surface 241.

As used herein, the terms "hole-injecting pixel" and "array of hole-injecting pixels" are used interchangeably with the terms "pixel" and "array of pixels," respectively.

As used herein, the phrase "individually addressable" means that each pixel of an array of hole-injecting pixels can be identified and manipulated independently from its neighboring or surrounding pixels. For example, referring to FIG. 2 each pixel 225A, 225B, or 225C can be individually turned on or off independently from its neighboring or surrounding pixels. However in some embodiments, instead of addressing the pixels 225A-C individually, a group of pixels, e.g., two or more pixels 225A-B can be selected and addressed together, i.e. the group of pixels 225A-B can be turned on or off together independently from the other pixels 225C or other groups of pixels (not illustrated).

In various embodiments, each pixel 225 of the array 220 can include a layer of nano-carbon materials. In other embodiments, each pixel 225 of the array 220 can include a layer of organic conjugated polymers. Yet in some other embodiments, each pixel 225 of the array 220 can include a layer of a mixture of nano-carbon materials and organic conjugated polymers including, for example, nano-carbon materials dispersed in one or more organic conjugated polymers. In certain embodiments, the surface resistivity of the layer including the one or more of nano-carbon materials and/or organic conjugated polymers can be from about 10 ohm/sq. to about 10,000 ohm/sq. or from about 10 ohm/sq. to about 5,000 ohm/sq. or from about 100 ohm/sq. to about 2,500 ohm/sq. The nano-carbon materials and the organic conjugated polymers can act as the hole-injection materials for the electrostatic generation of latent images. One of the advantages of using nano-carbon materials and the organic conjugated polymers as hole injection materials is that they can be patterned by various fabrication techniques, such as, for example, photolithography, inkjet printing, screen printing, transfer printing, and the like.

Hole-Injecting Pixels Including Nano-Carbon Materials

As used herein, the phrase "nano-carbon material" refers to a carbon-containing material having at least one dimension on the order of nanometers, for example, less than about 1000 nm. In embodiments, the nano-carbon material can include, for example, nanotubes including single-wall carbon nanotubes (SWNT), double-wall carbon nanotubes (DWNT), and multi-wall carbon nanotubes (MWNT); functionalized carbon nanotubes; and/or graphenes and functionalized graphenes, wherein graphene is a single planar sheet of $sp^2$-hybridized bonded carbon atoms that are densely packed in a honeycomb crystal lattice and is exactly one atom in thickness with each atom being a surface atom.

Carbon nanotubes, for example, as-synthesized carbon nanotubes after purification, can be a mixture of carbon nanotubes structurally with respect to number of walls, diameter, length, chirality, and/or defect rate. For example, chirality may dictate whether the carbon nanotube is metallic or semiconductive. Metallic carbon nanotubes can be about 33% metallic. Carbon nanotubes can have a diameter ranging from about 0.1 nm to about 100 nm, or from about 0.5 nm to about 50 nm, or from about 1.0 nm to about 10 nm; and can have a length ranging from about 10 nm to about 5 mm, or from about 200 nm to about 10 μm, or from about 500 nm to about 1000 nm. In certain embodiments, the concentration of carbon nanotubes in the layer including one or more nano-carbon materials can be from about 0.5 weight % to about 99 weight %, or from about 50 weight % to about 99 weight %, or from about 90 weight % to about 99 weight %. In embodiments, the carbon nanotubes can be mixed with a binder material to form the layer of one or more nano-carbon materials. The binder material can include any binder polymers as known to one of ordinary skill in the art.

In various embodiments, the layer of nano-carbon material(s) in each pixel 225 can include a solvent-containing coatable carbon nanotube layer. The solvent-containing coatable carbon nanotube layer can be coated from an aqueous dispersion or an alcohol dispersion of carbon nanotubes wherein the carbon nanotubes can be stabilized by a surfactant, a DNA or a polymeric material. In other embodiments, the layer of carbon nanotubes can include a carbon nanotube composite including, but not limited to, carbon nanotube polymer composite and/or carbon nanotube filled resin.

In embodiments, the layer of nano-carbon material(s) can be thin and have a thickness ranging from about 1 nm to about 1 μm, or from about 50 nm to about 500 nm, or from about 5 nm to about 100 nm.

Hole-Injecting Pixels Including Organic Conjugated Polymers

In various embodiments, the layer of organic conjugated polymers in each pixel 225 can include any suitable material, for example, conjugated polymers based on ethylenedioxythiophene (EDOT) or based on its derivatives. The conjugated polymers can include, but are not limited to, poly(3,4-ethylenedioxythiophene) (PEDOT), alkyl substituted EDOT, phenyl substituted EDOT, dimethyl substituted polypropylenedioxythiophene, cyanobiphenyl substituted 3,4-ethylenedioxythiopene (EDOT), teradecyl substituted PEDOT, dibenzyl substituted PEDOT, an ionic group substituted PEDOT, such as, sulfonate substituted PEDOT, a dendron substituted PEDOT, such as, dendronized poly(para-phenylene), and the like, and mixtures thereof. In further embodiments, the organic conjugated polymer can be a complex including PEDOT and, for example, polystyrene sulfonic acid (PSS). The molecular structure of the PEDOT-PSS complex can be shown as the following:

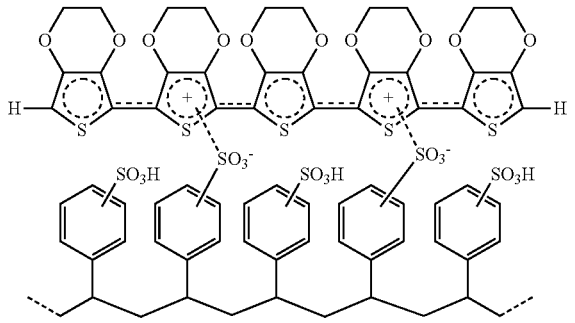

The exemplary PEDOT-PSS complex can be obtained through the polymerization of EDOT in the presence of the template polymer PSS. The conductivity of the layer containing the PEDOT-PSS complex can be controlled, e.g., enhanced, by adding compounds with two or more polar groups, such as for example, ethylene glycol, into an aqueous solution of PEDOT-PSS. As discussed in the thesis of Alexander M. Nardes, entitled "On the Conductivity of PEDOT-PSS Thin Films," 2007, Chapter 2, Eindhoven University of Technology, which is hereby incorporated by reference in its entirety, such an additive can induce conformational changes in the PEDOT chains of the PEDOT-PSS complex. The conductivity of PEDOT can also be adjusted during the oxidation step. Aqueous dispersions of PEDOT-PSS are commercially available as BAYTRON P® from H. C. Starck, Inc. (Boston, Mass.). PEDOT-PSS films coated on Mylar are commercially available in Orgacon™ films (Agfa-Gevaert Group, Mortsel, Belgium). PEDOT may also be obtained through chemical polymerization, for example, by using electrochemical oxidation of electron-rich EDOT-based monomers from aqueous or non-aqueous medium. Exemplary chemical polymerization of PEDOT can include those disclosed by Li Niu et al., entitled "Electrochemically Controlled Surface Morphology and Crystallinity in Poly(3,4-ethylenedioxythiophene) Films," Synthetic Metals, 2001, Vol. 122, 425-429; and by Mark Lefebvre al., entitled "Chemical Synthesis, Characterization, and Electrochemical Studies of Poly(3,4-ethylenedioxythiophene)/Poly(styrene-4-sulfonate) Composites," Chemistry of Materials, 1999, Vol. 11, 262-268, which are hereby incorporated by reference in their entirety. As also discussed in the above references, the electrochemical synthesis of PEDOT can use a small amount of monomer, and a short polymerization time, and can yield electrode-supported and/or freestanding films.

In various embodiments, the array of pixels 225 can be formed by first forming a layer including nano-carbon materials and/or organic conjugated polymers over the substrate 210. Any suitable methods can be used to form this layer including, for example, dip coating, spray coating, spin coating, web coating, draw down coating, flow coating, and/or extrusion die coating. The layer including nano-carbon materials and/or organic conjugated polymers over the substrate 210 can then be patterned or otherwise treated to create an array of pixels 225. Suitable nano-fabrication techniques can be used to create the array of pixel 225 including, but not limited to, photolithographic etching, or direct patterning. For example, the materials can be directly patterned by nano-imprinting, inkjet printing and/or screen printing. As a result, each pixel 225 of the array 220 can have at least one dimension, e.g., length or width, ranging from about 100 nm to about 500 μm, or from about 1 μm to about 250 μm, or from about 5 μm to about 150 μm.

Any suitable material can be used for the substrate 210 including, but not limited to, mylar, polyimide (PI), flexible stainless steel, poly(ethylene napthalate) (PEN), and flexible glass.

Charge Transport Layer

Referring back to FIG. 2, the nano-enabled imaging member 202 can also include the charge transport layer 240 configured to transport holes provided by the one or more pixels 225 to the surface 241 on an opposite side to the array of pixels 225. The charge transport layer 240 can include materials capable of transporting either holes or electrons through the charge transport layer 240 to selectively dissipate a surface charge. In certain embodiments, the charge transport layer 240 can include a charge-transporting small molecule dissolved or molecularly dispersed in an electrically inert polymer. In one embodiment, the charge-transporting small molecule can be dissolved in the electrically inert polymer to form a homogeneous phase with the polymer. In another embodiment, the charge-transporting small molecule can be molecularly dispersed in the polymer at a molecular scale. Any suitable charge transporting or electrically active small molecule can be employed in the charge transport layer 240. In embodiments, the charge transporting small molecule can include a monomer that allows free holes generated at the interface of the charge transport layer and the pixel 225 to be transported across the charge transport layer 240 and to the surface 241. Exemplary charge-transporting small molecules can include, but are not limited to, pyrazolines such as, for example, 1-phenyl-3-(4'-diethylamino styryl)-5-(4"-diethylamino phenyl)pyrazoline; diamines such as, for example, N,N'-diphenyl-N,N'-bis(3-methylphenyl)-(1,1'-biphenyl)-4,4'-diamine (TPD); other arylamines like triphenyl amine, N,N,N',N'-tetra-p-tolyl-1,1'-biphenyl-4,4'-diamine (TM-TPD); hydrazones such as, for example, N-phenyl-N-methyl-3-(9-ethyl)carbazyl hydrazone and 4-diethyl amino benzaldehyde-1,2-diphenyl hydrazone; oxadiazoles such as, for example, 2,5-bis(4-N,N'-diethylaminophenyl)-1,2,4-oxadiazole; stilbenes; aryl amines; and the like. Exemplary aryl amines can have the following formulas/structures:

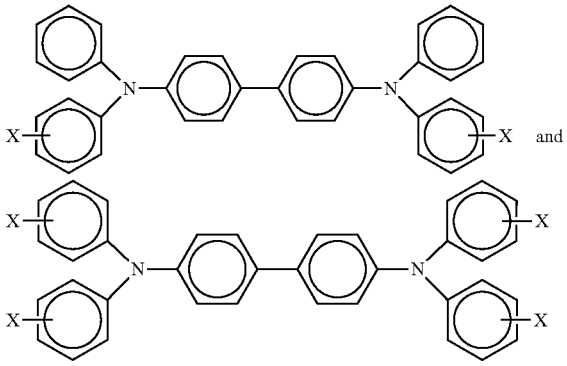

and wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

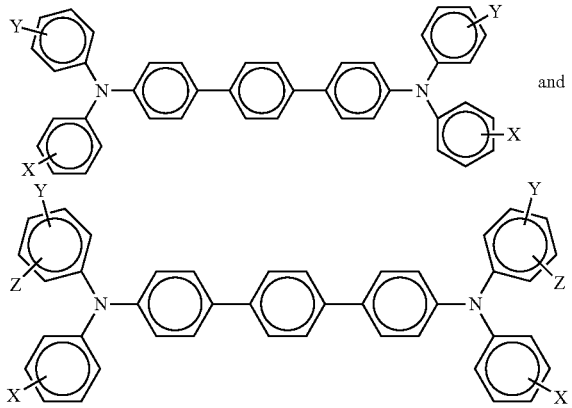

and wherein X, Y and Z are independently alkyl, alkoxy, aryl, a halogen, or mixtures thereof, and wherein at least one of Y and Z is present.

Alkyl and/or alkoxy groups can include, for example, from 1 to about 25 carbon atoms, or from 1 to about 18 carbon atoms, or from 1 to about 12 carbon atoms, such as methyl, ethyl, propyl, butyl, pentyl, and/or their corresponding alkoxides. Aryl group can include, e.g., from about 6 to about 36 carbon atoms of such as phenyl, and the like. Halogen can include chloride, bromide, iodide, and/or fluoride. Substituted alkyls, alkoxys, and aryls can also be used in accordance with various embodiments.

Examples of specific aryl amines that can be used for the charge transport layer 240 can include, but are not limited to, N,N'-diphenyl-N,N'-bis(alkylphenyl)-1,1'-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Any other known charge transport layer molecules can be selected such as, those disclosed in U.S. Pat. Nos. 4,921,773 and 4,464,450, the disclosures of which are incorporated herein by reference in their entirety.

As indicated above, suitable electrically active small molecule charge transporting molecules or compounds can be dissolved or molecularly dispersed in electrically inactive polymeric film forming materials. If desired, the charge transport material in the charge transport layer 240 can include a polymeric charge transport material or a combination of a small molecule charge transport material and a polymeric charge transport material. Any suitable polymeric charge transport material can be used, including, but not limited to, poly (N-vinylcarbazole); poly(vinylpyrene); poly(-vinyltetraphene); poly(vinyltetracene) and/or poly(vinylperylene).

Any suitable electrically inert polymer can be employed in the charge transport layer 240. Typical electrically inert polymer can include polycarbonates, polyarylates, polystyrenes, acrylate polymers, vinyl polymers, cellulose polymers, polyesters, polysiloxanes, polyamides, polyurethanes, poly(cyclo olefins), polysulfones, and epoxies, and random or alternating copolymers thereof. However, any other suitable polymer can also be utilized in the charge transporting layer 240 such as those listed in U.S. Pat. No. 3,121,006, the disclosure of which is incorporated herein by reference in its entirety.

In various embodiments, the charge transport layer 240 can include optional one or more materials to improve lateral charge migration (LCM) resistance including, but not limited to, hindered phenolic antioxidants, such as, for example, tetrakis methylene(3,5-di-tert-butyl-4-hydroxy hydrocinnamate) methane (IRGANOX®1010, available from Ciba Specialty Chemical, Tarrytown, N.Y.), butylated hydroxytoluene (BHT), and other hindered phenolic antioxidants including SUMILIZER™ BHT-R, MDP-S, BBM-S, WX-R, NW, BP-76, BP-101, GA-80, GM, and GS (available from Sumitomo Chemical America, Inc., New York, N.Y.), IRGANOX® 1035, 1076, 1098, 1135, 1141, 1222, 1330, 1425WL, 1520L, 245, 259, 3114, 3790, 5057, and 565 (available from Ciba Specialties Chemicals, Tarrytown, N.Y.), and ADEKA STABT™ AO-20, AO-30, AO-40, AO-50, AO-60, AO-70, AO-80, AO-330 (available from Asahi Denka Co., Ltd.); hindered amine antioxidants such as SANOL™ LS-2626, LS-765, LS-770, and LS-744 (available from SANKYO CO., Ltd.), TINUVIN® 144 and 622LD (available from Ciba Specialties Chemicals, Tarrytown, N.Y.), MARK™ LA57, LA67, LA62, LA68, and LA63 (available from Amfine Chemical Corporation, Upper Saddle River, N.J.), and SUMILIZER TPS (available from Sumitomo Chemical America, Inc., New York, N.Y.); thioether antioxidants such as SUMILIZER® TP-D (available from Sumitomo Chemical America, Inc., New York, N.Y.); phosphite antioxidants such as MARK™ 2112, PEP-8, PEP-24G, PEP-36, 329K, and HP-10 (available from Amfine Chemical Corporation, Upper Saddle River, N.J.); other molecules such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The charge transport layer 240 can have antioxidant in an amount ranging from about 0 to about 20 weight %, from about 1 to about 10 weight %, or from about 3 to about 8 weight % based on the total charge transport layer.

The charge transport layer 240 including charge-transporting molecules or compounds dispersed in an electrically inert polymer can be an insulator to the extent, that the electrostatic charge placed on the charge transport layer 240 is not conducted such that formation and retention of an electrostatic latent image thereon can be prevented. On the other hand, the charge transport layer 240 can be electrically "active" in that it allows the injection of holes from the layer including one or more of nano-carbon materials and organic conjugated polymers in each pixel 225 of the array of hole-injecting pixels 225, and allows these holes to be transported through the charge transport layer 240 itself to enable selective discharge of a negative surface charge on the surface 241.

Any suitable and conventional techniques can be utilized to form and thereafter apply the charge transport layer 240 over the array of pixels 225. For example, the charge transport layer 240 can be formed in a single coating step or in multiple coating steps. These application techniques can include spraying, dip coating, roll coating, wire wound rod coating, ink jet coating, ring coating, gravure, drum coating, and the like.

Drying of the deposited coating can be effected by any suitable conventional technique such as oven drying, infra red radiation drying, air drying and the like. The charge transport layer 240 after drying can have a thickness in the range of about 1 μm to about 50 μm, about 5 μm to about 45 μm, or about 15 μm to about 40 μm, but can also have thickness outside this range.

Optional Adhesion Layer

In some embodiments, the nano-enabled imaging member 202 can also include an optional adhesion layer 271 disposed between the substrate 210 and each pixel 225 of the array of pixels 225. Exemplary polyester resins which may be utilized for the optional adhesion layer can include polyarylatepolyvinylbutyrals, such as, U-100 available from Unitika Ltd., Osaka, JP; VITEL PE-100, VITEL PE-200, VITEL PE-200D, and VITEL PE-222, all available from Bostik, Wauwatosa, Wis.; MOR-ESTER™ 49000-P polyester available from Rohm Hass, Philadelphia, Pa.; polyvinyl butyral; and the like.

Optional Hole Blocking Layer

The nano-enabled imaging member 202 can also include an optional hole blocking layer 275 disposed between the layer including one or more of nano-carbon materials and/or organic conjugated polymers in the pixel 225 and the charge transport layer 240. In some embodiments, an optional adhesion layer 273 can be disposed between the charge transport layer 240 and the hole blocking layer 275 and/or between the hole blocking layer 275 and the pixel 225 including the layer of one or more nano-carbon materials and organic conjugated polymers.

The hole blocking layer 275 can include polymers such as, for example, polyvinylbutryrals, epoxy resins, polyesters, polysiloxanes, polyamides, polyurethanes and the like; nitrogen containing siloxanes or nitrogen containing titanium compounds such as, for example, trimethoxysilyl propylene diamine, hydrolyzed trimethoxysilyl propyl ethylene diamine, N-beta-(aminoethyl)gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$ (gamma-aminopropyl)methyl diethoxysilane, as disclosed in U.S. Pat. Nos. 4,338,387, 4,286,033 and 4,291,110, the disclosures of which are incorporated by reference herein in their entirety. The hole blocking layer 275 can have a thickness in the range of about 0.005 μm to about 0.5 μm, or about 0.01 μm to about 0.1 μm, or about 0.03 μm and about 0.06 μm.

First Charging Subsystem

Figure 3A:
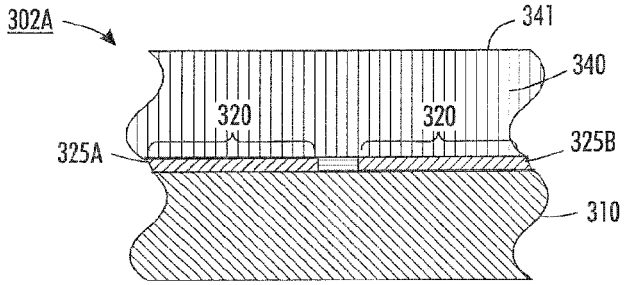
FIGS. 3A-3D schematically illustrate an exemplary method of forming an electrostatic latent image according to various embodiments of the present teachings.
Figure 3B:
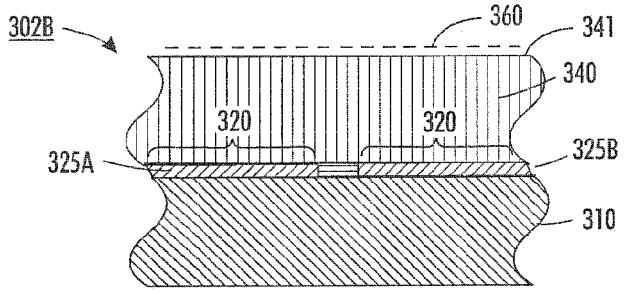

Referring back to FIG. 1, the exemplary digital offset printing system 100 can also include a first charging subsystem 116 for uniformly charging a surface of the charge transport layer surface of the nano-enabled imaging member 102 (also see 202 of FIGS. 2 and 302A of FIG. 3A). FIGS. 3A-3D schematically illustrate an exemplary method of forming an electrostatic latent image on the nano-enabled imaging member 302A-D according to various embodiments of the present teachings. For example, as shown in FIG. 3B, a substantially uniform negative surface charge 360 can be formed on the surface 341 of the nano-enabled imaging member 302A of FIG. 3A. Exemplary subsystems that can provide an electric field can include corotron, scorotron, discorotron, bias charged roll, bias transfer roll, and the like.

Digital Latent Image Generating Subsystem

Figure 3C:
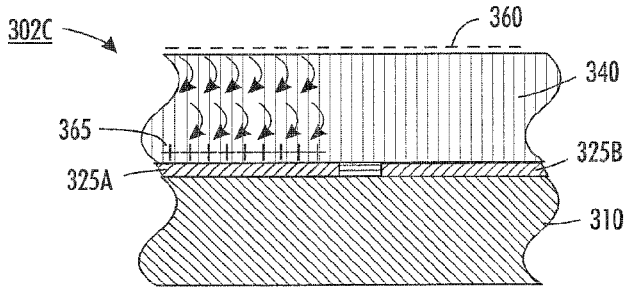
Figure 3D:
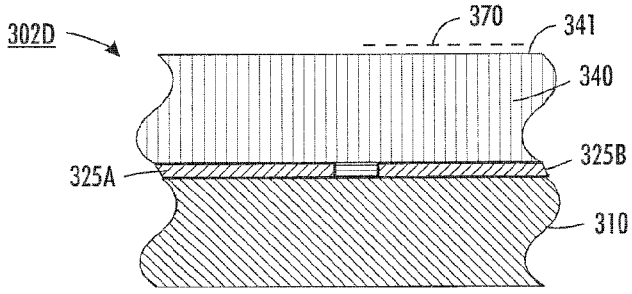

As shown in FIG. 1, the exemplary digital offset printing system 100 can also include a digital latent image generating subsystem 109 coupled to the nano-enabled imaging member 102 to form a latent image 170 on the surface of the charge transport layer surface of the nano-enabled imaging member 102. In various embodiments, the digital latent image generating subsystem 109 can include a processor configured to address one or more thin film transistors of the array 220. FIG. 3C schematically illustrates a portion of the nano-enabled imaging member 302C, an electrostatic latent image generator, wherein the pixel 325A can be selectively addressed by applying a bias thereon but with the pixel 325B un-biased. As a result, the one or more nano-carbon materials and/or conjugated polymer disposed in the pixel 325A can inject holes 365 at the interface of the pixel 325A and the charge transport layer 340. As shown in FIG. 3C, the charge transport layer 340 can transport the holes 365 to the surface 341 to neutralize the negative surface charge 360 to create a latent image 370. FIG. 3D schematically illustrates a portion of the electrostatic latent image generator 302D including a latent image 370 formed by selectively addressing one or more pixels 325 to discharge a portion of the negative surface charge 360 on the surface 341 of the charge transport layer 340 corresponding to the selectively addressed one or more pixels 325.

Development Subsystem

As shown in FIG. 1, the exemplary digital offset printing system 100 can further include a reservoir of liquid-based ink 105 and, optionally, a second charger 117. In some embodiments, the optionally disposed second charger 117 can be a part of a development subsystem 104. In other embodiments, the second charger 117 can be a separate unit. The optionally disposed second charger 117 can be configured to add a charge to the ink 105 forming a charged ink 105' prior to the development nip 103 such that the latent image 170 or 370 can be developed through the development nip 103 forming a developed image 145.

Any suitable liquid based ink can be used including, such as, for example, flexo ink, UV flexo ink, offset ink, UV offset ink, water less offset ink, water based offset ink and/or hydrocarbon (e.g., isopar) based liquid ink. Exemplary offset ink can also include, but are not limited to, UVivid 820 Series UV Flexo ink, UVivid 850 Series UV Flexo ink, and UVivid 800 Series UV Flexo ink, all manufactured by FUJIFILM North America Corporation, Kansas City, Kans.; T&K Toka ALPO G QMDI waterless offset ink, Best One Mixing Inks, UV BF Inks, and UV VNL Inks, all manufactured by Spectro Printing Ink, LLC, Ralston, Nebr.; Megacure series, Megacure MW SO series, Megacure PV series, and Megacure HB series UV offset inks manufactured by Megami Ink Manufacturer, Ltd., Tokyo, JP; and Royal color, NWUV-16-846 and NWUV-16-848/849 UV flexo inks, and NWS2-10-931 water based flexo ink, manufactured by Atlantic Printing Ink, Ltd., Tampa, Fla.

In certain embodiments when flexo-based ink is used for an exemplary flexo printing, the second charger 117 can be optional, i.e., can be removed from the system 100. For example, the latent image 170 or 370 can be developed through the development nip 103 with flexo ink and UV flexo ink, either charged or uncharged, to form a developed flexo-based image on the imaging member 102.

Partial Curing Subsystem

In some embodiments, the exemplary digital printing system 100 can optionally include UV-curing units 160*a-b* for curing the developed image 145, when UV-curable inks are used. The UV-curing units 160*a-b* can include, for example, a UV lamp or UV LED device. In exemplary embodiments, the UV-curable ink (see 145) can be partially cured with the UV-curing unit 160*a* prior to the transfix process and can be finally cured after the transfix process with a second UV-curing unit 160*b*. The UV-curable ink can include, for example, UV flexo ink or UV offset ink.

Transfix Subsystem

In various embodiments, the exemplary digital offset printing system 100 can include a transfix subsystem 108 for transferring and fixing the developed image 145 onto a media 106, as shown in FIG. 1. Depending on the ink used, the developed image can be fixed on the media 106, for example, by heat, pressure, and/or UV radiation. In some embodiments, the development subsystem 104 can also include a final curing unit for curing the partially cured developed image 145.

Cleaning Subsystem

In some embodiments, the digital offset printing system 100 can further include a cleaning subsystem 107 to clean offset ink remaining on the nano-enabled imaging member 102 after the transfix process but prior to the next print cycle.

In some embodiments, the cleaning subsystem can include a compliant cleaning blade. The blade can rub against the nano-enabled imaging member 102 and can scrape off any developing material that attempts to pass under it. In other embodiments, the cleaning subsystem 107 can include a rotating brush cleaner, which can be more efficient at removing developing material and less abrasive to the nano-enabled imaging member 102.

According to various embodiments, there is a method 400 of digital printing an image onto a media. The method can include a step 481 of providing a nano-enabled imaging member, such as, for example, the nano-enabled imaging member 102, 202, 302 as shown in FIGS. 1-3. The nano-enabled imaging member can include an array 220 of hole-injecting pixels 225 disposed over a substrate 210 and a charge transport layer 240 disposed over the array of hole-injecting pixels 225, wherein each pixel 225 of the array can be electrically isolated and individually addressable. The nano-enabled imaging member can also include an array of thin film transistors 250 disposed between the substrate 210 and the array 220, such that each thin film transistor 255 can be coupled to one or more pixels 225 of the array of pixels 225. The method 400 can also include a step 482 of creating a negative surface charge on a surface of the charge transport layer, the surface being disposed on a side opposite to the array of hole-injecting pixels. The method 400 can further include a step 483 of forming a latent image on the surface of the charge transport layer by selectively or individually addressing one or more hole-injecting pixels to discharge a portion of the negative surface charge on the charge transport layer corresponding to the one or more selectively addressed pixels, as shown in FIGS. 3A-3D. For example, as shown in FIG. 3C, the one or more addressed pixels 325 can eject holes at the interface of the one or more pixels 325 and the charge transport layer 340, and the charge transport layer 340 can further transport the holes to its surface 341. In various embodiments, the step 483 of selectively addressing one or more hole-injecting pixels can include applying an electrical bias to one or more hole-injecting pixels via thin film transistors to either enable hole ejection or disable hole injection at the interface of the one or more hole-injecting pixels and the charge transport layer.

The method 400 can also include the step 484 of providing an ink in proximity to a development nip. In one embodiment when exemplary offset ink is used, the offset ink can be charged to form a charged offset ink by, for example, a charger (see 117 of FIG. 1). In another embodiment when exemplary flexo ink is used, the charging of flexo ink can be optional. The method 400 can further include a step 485 of electrostatically developing the latent image at the development nip by the charged offset ink or uncharged flexo ink to form a developed image on the surface of the charge transport layer of the nano-enabled imaging member. The method 400 of digital printing an image onto a media can also include a step 486 of transfixing the developed image onto a media. The method 400 can further include cleaning the nano-enabled imaging member 102 after a printing process.

In this manner, the method 400 can form an electrostatic latent image or a surface charge contrast and develop the electrostatic latent image or the surface charge contrast to print a developed image without the use of photoreceptor, laser rastor output scanner (ROS), or plate development. The lack of photoreceptor, laser ROS, and plate development can simplify the printing processes and can also reduce unit manufacturing cost (UMC) and run cost.

Figure 4:
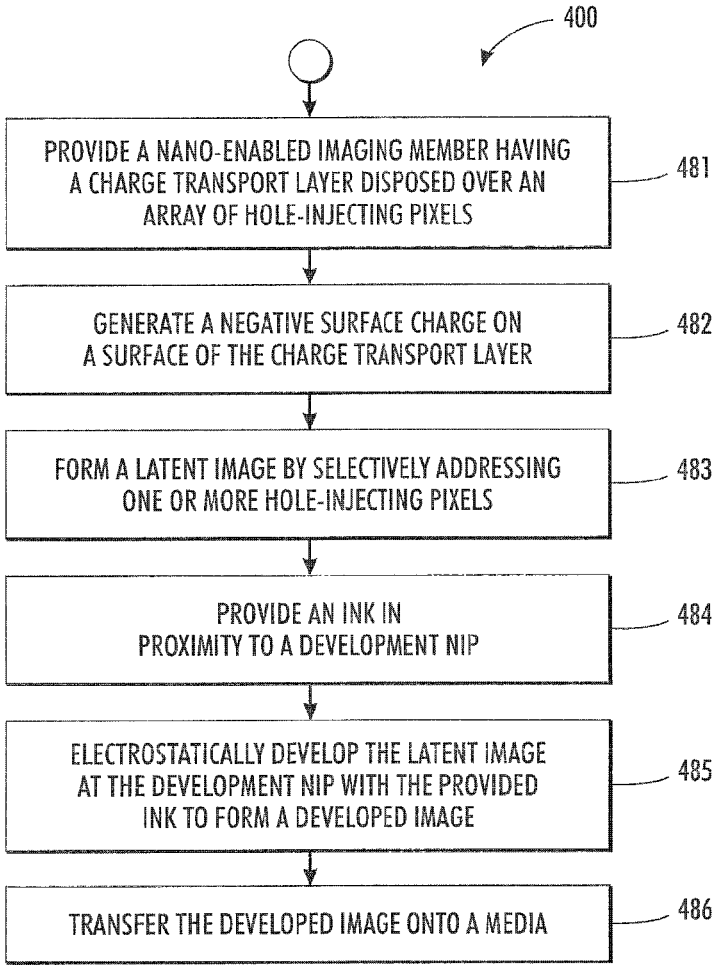
FIG. 4 illustrates an exemplary method of digital offset printing an image onto a media according to various embodiments of the present teachings.

In embodiments, the steps described above for the method of FIG. 4 may be added, omitted, combined, altered, or performed in different orders. In embodiments, the charge polarity can be reversed between positive and negative charges or between the hole-related and the electron-related charges.

In an exemplary embodiment, the nano-enabled imaging member 102 including exemplary carbon nanotubes and/or PEDOT can be integrated with an active matrix backplane in a drum configuration. Alternatively, the nano-enabled imaging member 102 can be in a belt configuration using a flexible substrate including, for example, polyimide, Poly(ethylene naphthalate) (PEN), or poly(ethylene terephthalate) (PET). The nano-enabled imaging member 102 can be first charged negatively by a corona device. Digital electrostatic latent image can then be formed depending on the bias of selected pixel(s) and can further be electrostatically developed by uncharged or charged flexo ink, and the charged offset ink which was previously charged positively by another corona device. The ink image can be transfused onto a medium to produce a digital offset/flexo print. Optionally, UV-curable inks can be used. The UV-curable ink can be partially cured with a UV lamp or UV LED device before transfix and finally cured with another UV-curing device.

The following examples are illustrative of various embodiments and their advantageous properties, and are not to be taken as limiting the disclosure or claims in any way.

EXAMPLES

Example 1

Preparation of a Bi-Layer Imaging Member Including Carbon Nanotube Film and a Charge Transport Layer Four bi-layer imaging members (A, B, C, D) were formed by first depositing a layer of single walled carbon nanotube (CNT) film as a hole injection layer on each of four Mylar substrates such that each CNT film on the Mylar substrate had a surface resistivity of about 100 O/sq, about 250 O/sq, about 1000 O/sq, and about 2500 O/sq. Then, a solution of about 14 wt. % (solid) containing N,N'-diphenyl-N,N-bis(3-methyl phenyl)-1,1'-biphenyl-4,4'-diamine (TPD) and PCZ200 (a polycarbonate) in a mixed solvent of tetrahydrofuran and toluene (70:30 in ratio) was coated over each of the four CNT films (on Mylar) on a lab draw-down coater using a 3-5 mil draw bar to form a charge transport layer (CTL) of about 20 μm thick. The thickness of the CTL was controlled by the solid concentration of the coating solution as well as the wet gap of the draw bar. The resulting bi-layer imaging members (A, B, C, D) were air dried for about 30 minutes followed by vacuum drying at about 100° C. for about 2 hours before electrical evaluation.

Example 2

Preparation of a Bi-Layer Imaging Member Including PEDOT and a Charge Transport Layer Three bi-layer imaging members (E, F, G) were formed by first depositing a layer of PEDOT on each of three Mylar substrates such that each PEDOT film had a surface resistivity of about 350 O/sq, about 1500 O/sq, and about 2500 O/sq. The PEDOT films with surface resistivity of about 350 O/sq. and about 1500 O/sq. were obtained from Agfa-Gevaert Group (Mortsel, Belgium). The PEDOT film with surface resistivity of about 2500 O/sq was coated internally using a web coater with the PEDOT ink purchased from Orgacon films Ltd. A solution of about 14 wt. % (solid) containing N,N'-diphenyl-N,N-bis(3-methyl phenyl)-1,1'-biphenyl-4,4'-diamine (TPD) and PCZ200 (a polycarbonate) in a mixed solvent of tetrahydrofuran and toluene (70:30 in ratio) was then coated over each of the three PEDOT films (on Mylar) on a lab draw-down coater using a 3-5 mil draw bar to form a charge transport layer (CTL) of about 20 μm thick. The thickness of the CTL was controlled by the solid concentration of the coating solution as well as the wet gap of the draw bar. The resulting bi-layer imaging members (E, F, G) were air dried for about 30 minutes followed by vacuum drying at about 100° C. for about 2 hours before electrical evaluation.

Example 3

Charge-Discharge Characteristics of the Bi-Layer Imaging Members

Figure 5:
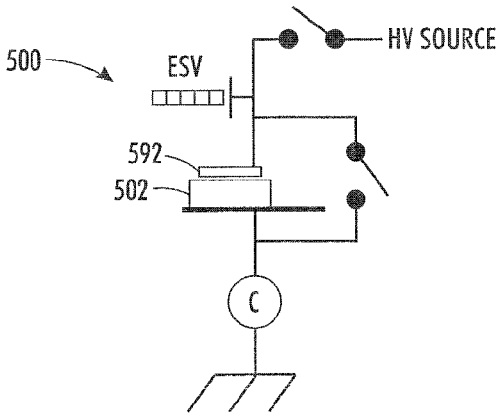
FIG. 5 illustrates a static scanner used to measure the charge-discharge characteristics of exemplary bi-layer imaging members according to various embodiments of the present teachings.

The charge-discharge characteristics of the bi-layer imaging members of Example 1 and Example 2 were evaluated using an in-house static scanner 500, as shown schematically in FIG. 5. A gold dot 592 was evaporated on the CTL layer of each bi-layer imaging member 502 for the electrical contact. Each bi-layer imaging member 502 was charged by a high voltage power supply and the surface potential was monitored using an electrostatic voltmeter (ESV). The high voltage power supply and the ESV were part of the static scanner and were both obtained from TREK, Inc. (New York), including a Trek model 610B corotrol power supply and a Trek model 368A high-speed electrostatic voltmeter. The motionless scanner was built internally at Xerox. Since the bi-layer imaging member was "static" throughout the measurement, the charging and monitoring of the surface potential was controlled electronically through an electric circuit within the static scanner. Typically there was a ~0.1 s delay between charging and monitoring.

Figure 6A:
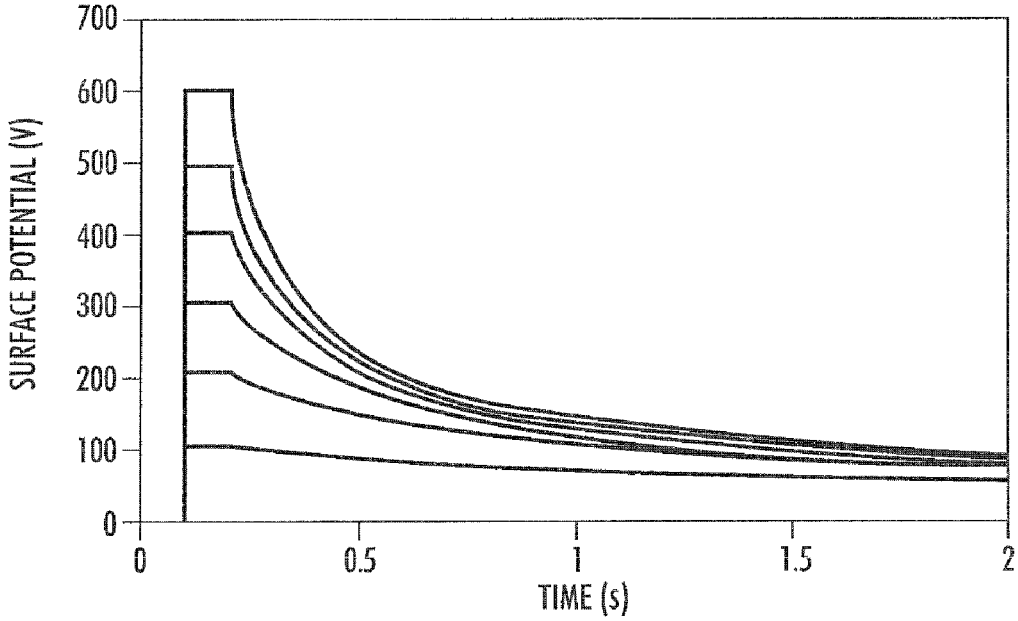
FIGS. 6A-6B compare charge-discharge curves of an exemplary carbon nanotube bi-layer imaging member and a control member according to various embodiments of the present teachings.
Figure 6B:
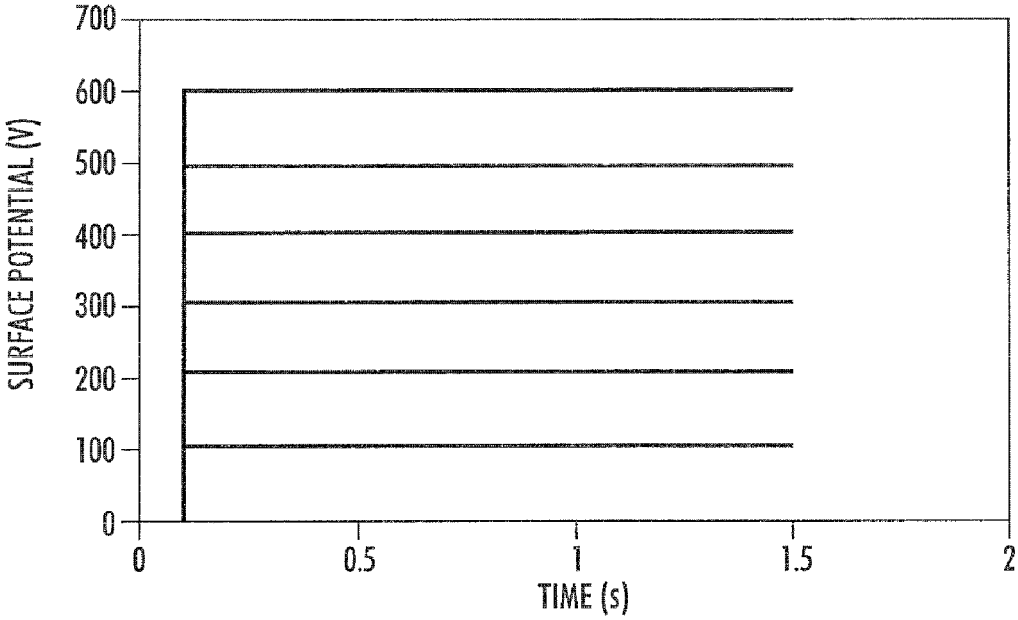

FIG. 6A shows charge-discharge curve of a CNT bi-layer imaging member of Example 1, while FIG. 6B shows charge-discharge curve of a control bi-layer imaging member where the CNT film is replaced by a Ti/Zr metal layer. As shown in FIG. 6A, the CNT bi-layer imaging member charges capacitively. Unlike the control, the CNT bi-layer imaging member underwent rapid discharge as soon as the electric field across the bi-layer imaging members was established.

The initial discharge rate (dV/dt) of the CNT bi-layer imaging members was found to be sensitive to the surface resistivity of the carbon nanotube film. The PEDOT bi-layer imaging members were found to charge and discharge analogously. The results are summarized in Table 1.

TABLE 1

| Device | Hole injecting film | Surface resistivity of Hole injecting film (O/sq) | CTL thickness (μm) | dV/dt at E-field ~33 V/μm |
|---|---|---|---|---|
| A | CNT | ~100 | 18 | 68,780 |
| B | CNT | ~250 | 18 | 56,083 |
| C | CNT | ~1000 | 18 | 30,267 |
| D | CNT | ~2500 | 18 | 12,550 |
| E | PEDOT | ~350 | 23 | 75,562 |
| F | PEDOT | ~1500 | 23 | 54,735 |
| G | PEDOT | ~2500 | 21 | 31,333 |

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising."

Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A digital printing method comprising:

providing a nano-enabled imaging member comprising an array of hole-injecting pixels disposed over a substrate and a charge transport layer disposed over the array of hole-injecting pixels, wherein each pixel of the array of hole-injecting pixels is electrically isolated and individually addressable;

generating a negative surface charge on a surface of the charge transport layer;

forming a latent image by selectively addressing one or more pixels of the array of hole-injecting pixels to discharge a portion of the negative surface charge corresponding to the selectively addressed one or more pixels;

providing an ink in proximity to a development nip formed by a development subsystem and the nano-enabled imaging member, wherein the provided ink comprises a charged offset ink and an optionally charged flexo ink;

electrostatically developing the latent image at the development nip with the provided ink to form a developed image on the charge transport layer of the nano-enabled imaging member; and transferring the developed image from the nano-enabled imaging member onto a media.

2. The method of claim 1, wherein the nano-enabled imaging member further comprises an array of thin film transistors disposed over the substrate, such that each thin film transistor is connected to one pixel of the array of hole-injecting pixels.

3. The method of claim 2, wherein the step of forming a latent image by selectively addressing one or more pixels comprises applying an electrical bias to the one or more pixels via thin film transistors to enable hole injection at the interface of each of the one or more selectively addressed pixels and the charge transport layer.

4. The method of claim 1, wherein each pixel of the array of hole-injecting pixels comprises one or more of a nano-carbon material and a conjugated polymer.

5. The method of claim 4, wherein the nano-carbon material comprises one or more of a single-wall carbon nanotube, a double-wall carbon nanotube, a multi-wall carbon nanotube, graphene and a mixture thereof.

6. The method of claim 4, wherein the conjugated polymer is selected from the group consisting of poly(3,4-ethylenedioxythiophene), alkyl substituted EDOT, phenyl substituted 3,4-ethylenedioxythiophene, dimethyl substituted polypropylenedioxythiophene, cyanobiphenyl substituted 3,4-ethylenedioxythiopene, teradecyl substituted poly(3,4-ethylenedioxythiophene), dibenzyl substituted poly(3,4-ethylenedioxythiophene), sulfonate substituted poly(3,4-ethylenedioxythiophene), dendron substituted poly(3,4-ethylenedioxythiophene), a complex of poly(3,4-ethylenedioxythiophene)-polystyrene sulfonic acid, and a mixture thereof.

7. The method of claim 1, wherein the charge transport layer comprises a charge transporting small molecule dispersed in an electrically inert polymer, wherein the charge transporting small molecule is selected from the group consisting of pyrazoline, diamine, hydrazone, oxadiazole, stilbene, aryl amine, N,N'-diphenyl-N,N'-bis(alkylphenyl)-1,1'-biphenyl-4,4'-diamine with alkyl selected from the group consisting of methyl, ethyl, propyl, butyl, hexyl, and a mixture thereof; N,N'-diphenyl-N,N'-bis(chlorophenyl)-1,1'-biphenyl-4,4'-diamine; N,N'-bis(4-butylphenyl)-N,N'-di-p-tolyl-[p-terphenyl]-4,4"-diamine; N,N'-bis(4-butylphenyl)-N,N'-di-m-tolyl-[p-terphenyl]-4,4"-diamine; N,N'-bis(4-butylphenyl)-N,N'-di-o-tolyl-[p-terphenyl]-4,4"-diamine; N,N'-bis(4-butylphenyl)-N,N'-bis-(4-isopropylphenyl)-[p-terphenyl]-4,4"-diamine; N,N'-bis(4-butylphenyl)-N,N'-bis-(2-ethyl-6-methylphenyl)-[p-terphenyl]-4,4"-diamine; N,N'-bis(4-butylphenyl)-N,N'-bis-(2,5-dimethylphenyl)-[p-terphenyl]-4,4'-diamine; N,N'-diphenyl-N,N'-bis(3-chlorophenyl)-[p-terphenyl]-4,4"-diamine; and a mixture thereof, and wherein the electrically inert polymer is selected from the group consisting of polycarbonate, polyarylate, polystyrene, acrylate polymer, vinyl polymer, cellulose polymer, polyester, polysiloxane, polyamide, polyurethane, poly(cyclo olefin), polysulfone, and epoxy, and random or alternating copolymers thereof.

8. The method of claim 1, wherein the charged offset ink further comprises a charged UV offset ink, a charged water less offset ink, or a charged water based offset ink;

the optionally charged flexo ink further comprises an optionally charged UV flexo ink; and the provided ink further comprises an optionally charged hydrocarbon based liquid ink.

9. The method of claim 1, wherein the step of transferring the developed image from the nano-enabled imaging member onto a media comprises transfusing the developed image on the media.

10. The method of claim 1, wherein the step of transferring the developed image from the nano-enabled imaging member onto a media further comprises:

partially UV-curing the developed image to form a partially cured developed image on the nano-enabled imaging member when the provided ink is UV-curable;

transferring the partially cured developed image onto the media; and curing the partially cured developed image on the media.

11. A digital printing system comprising:

a nano-enabled imaging member for forming an electrostatic latent image, the nano-enabled imaging member comprising an array of hole-injecting pixels disposed over a substrate and a charge transport layer disposed over the array of hole-injecting pixels, wherein each pixel of the array of hole-injecting pixels is electrically isolated and individually addressable;

a first charging subsystem for uniformly charging a surface of the charge transport layer of the nano-enabled imaging member to form a substantially uniform negative surface charge on the charge transport layer;

a digital latent image generating subsystem coupled to the nano-enabled imaging member to discharge a portion of the negative surface charge and form a latent image on the nano-enabled imaging member;

a development subsystem for developing the latent image with an ink through a development nip formed by the development subsystem and the nano-enabled imaging member, wherein the ink comprises a charged offset ink and an optionally charged flexo ink; and a transfix subsystem for transferring and fixing the developed image from the nano-enabled imaging member onto a media.

12. The system of claim 11, wherein the nano-enabled imaging member further comprises an array of thin film transistors disposed over the substrate, such that each thin film transistor is configured to apply an electrical bias to one or more pixels of the array of hole-injecting pixels to discharge the portion of the negative surface charge.

13. The system of claim 12, wherein the digital latent image generating subsystem further comprises a processor configured to address one or more thin film transistors of the array of thin film transistors.

14. The system of claim 11, further comprising a second charger optionally disposed proximate to the development nip for charging the ink to provide the charged offset ink and the optionally charged flexo ink.

15. The system of claim 11, wherein the each pixel of the array of hole-injecting pixels comprises one or more of a nano-carbon material and a conjugated polymer;

wherein the nano-carbon material comprises one or more of a single-wall carbon nanotube, a double-wall carbon nanotube, a multi-wall carbon nanotube, and graphene; and wherein the conjugated polymer is selected from the group consisting of poly(3,4-ethylenedioxythiophene), alkyl substituted EDOT, phenyl substituted 3,4-ethylenedioxythiophene, dimethyl substituted polypropylenedioxythiophene, cyanobiphenyl substituted 3,4-ethylenedioxythiopene, teradecyl substituted poly(3,4-ethylenedioxythiophene), dibenzyl substituted poly(3,4-ethylenedioxythiophene), sulfonate substituted poly(3,4-ethylenedioxythiophene), dendron substituted poly(3,4-ethylenedioxythiophene), a complex of poly(3,4-ethylenedioxythiophene)-polystyrene sulfonic acid, and a mixture thereof.

16. The system of claim 11, wherein the charge transport layer comprises a charge transporting small molecule dispersed in an electrically inert polymer, wherein the charge transporting small molecule is selected from the group consisting of N,N'-diphenyl-N,N'-bis(alkylphenyl)-1,1'-biphenyl-4,4'-diamine with alkyl selected from the group consisting of methyl, ethyl, propyl, butyl, hexyl, and a mixture thereof; N,N'-diphenyl-N,N'-bis(chlorophenyl)-1,1'-biphenyl-4,4'-diamine; N,N'-bis(4-butylphenyl)-N,N'-di-p-tolyl-[p-terphenyl]-4,4"-diamine; N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine; N,N'-bis(4-butylphenyl)-N,N'-bis-(4-isopropylphenyl)-[p-terphenyl]-4,4"-diamine; N,N'-bis(4-butylphenyl)-N,N'-bis-(2-ethyl-6-methylphenyl)-[p-terphenyl]-4,4"-diamine; N,N'-bis(4-butylphenyl)-N,N'-bis-(2,5-dimethylphenyl)-[p-terphenyl]-4,4'-diamine; N,N'-diphenyl-N,N'-bis(3-chlorophenyl)-[p-terphenyl]-4,4"-diamine; and a mixture thereof, and wherein the electrically inert polymer is selected from the group consisting of polycarbonate, polystyrene, polyarylate, acrylate polymer, vinyl polymer, cellulose polymer, polyester, polysiloxane, polyamide, polyurethane, poly(cyclo olefin), polysulfone, and epoxy, and random or alternating copolymers thereof.

17. The system of claim 11, wherein the charged offset ink further comprises a charged UV offset ink, a charged water less offset ink, or a charged water based offset ink;

the optionally charged flexo ink further comprises an optionally charged UV flexo ink; and the provided ink further comprises an optionally charged hydrocarbon based liquid ink.

18. The system of claim 11, wherein the charge transport layer of the nano-enabled imaging member has a thickness ranging from about 5 μm to about 45 μm.

19. The system of claim 11, wherein the each pixel of the array of hole-injecting pixels has a surface resistivity ranging from about 10 ohm/sq. to about 5,000 ohm/sq.

20. An offset/flexo printing method comprising:

providing a nano-enabled imaging member comprising an array of hole-injecting pixels disposed over a substrate and a charge transport layer disposed over the array of hole-injecting pixels, wherein each pixel of the array of hole-injecting pixels is electrically isolated and individually addressable via an array of thin film transistors disposed over the substrate;

forming a negative surface charge on a surface of the charge transport layer opposite to the array of hole-injecting pixels;

forming a latent image by selectively addressing one or more pixels of the array of hole-injecting pixels to inject holes at interface of the charge transport layer and each of the one or more selectively addressed pixels, such that a portion of the negative surface charge corresponding to the one or more selectively addressed pixels is discharged;

optionally charging a UV-curable ink provided in proximity to a development nip formed by a development subsystem and the nano-enabled imaging member, wherein the optionally charged UV-curable ink comprises a charged UV-curable offset ink and an optionally charged UV-curable flexo ink;

electrostatically developing the latent image at the development nip with the optionally charged UV-curable ink to form a developed image on the nano-enabled imaging member;

partially UV-curing the developed image to form a partially cured developed image on the nano-enabled imaging member;

transferring the partially cured developed image onto the media; and curing the partially cured developed image on the media.

* * * * *